US005937563A

United States Patent [19]

Schuetz et al.

[11] Patent Number: 5,937,563

[45] **Date of Patent: *Aug. 17, 1999**

[54] MODIFIED FIREARMS FOR FIRING SIMULATED AMMUNITION

[76] Inventors: Robert C. E. Schuetz, 2125 Quiemoth St., SE., Olympia, Wash. 98513; Brian D. Schuetz, 520 Schuetz La., Olympia, Wash. 98502

[ * ] Notice: This patent is subject to a terminal disclaimer.

[21] Appl. No.: 09/020,558

[22] Filed: Feb. 9, 1998

Related U.S. Application Data

[63] Continuation-in-part of application No. 08/832,497, Apr. 3, 1997, Pat. No. 5,740,626.

[51] Int. Cl.[6] ..... F41C 27/00

[52] U.S. Cl. ..... 42/106; 42/76.01

[58] Field of Search ..... 42/106, 76.01

[56] References Cited

U.S. PATENT DOCUMENTS

| | | | |
|---|---|---|---|
| 2,119,169 | 5/1938 | Lauf | 42/3 |
| 3,968,727 | 7/1976 | Hyytinen | 89/191 A |
| 3,990,348 | 11/1976 | Vesamaa | 89/193 |
| 4,872,392 | 10/1989 | Powers et al. | 89/193 |
| 5,218,163 | 6/1993 | Dabrowski | 89/193 |
| 5,429,034 | 7/1995 | Badali | 89/193 |

*Primary Examiner*—Charles T. Jordan
*Assistant Examiner*—Meena Chelliah
*Attorney, Agent, or Firm*—Michael J. Caddell

[57] ABSTRACT

The present invention discloses a firearms safety system for adapting conventional handheld firearms to fire non-deadly simulated training ammunition, which system provides a series of gas relief ports and passages to prevent the successful firing of live ammunition in the firearm. The system can be advantageously utilized in modified M16 type military type rifles which have been previously adapted to fire pistol cartridges such as the 9 mm and .40 S&W calibers. The system is also particularly advantageous for use in handheld firearms such as pistols and revolvers, as well as in conventional long guns such as bolt action rifles, and all shotguns.

16 Claims, 4 Drawing Sheets

MODIFIED FIREARMS FOR FIRING SIMULATED AMMUNITION

CROSS-REFERENCE TO RELATED APPLICATION

This application is a continuation-in-part of a prior application of the same title, filed on Apr. 3, 1997, Ser. No. 08/832,497, U.S. Pat. No. 5,740,626; by Robert C. E. Schuetz.

BACKGROUND OF THE INVENTION

The present invention is directed to firearms which can be converted to fire simulated ammunition for training purposes, for example in military weapons like the M16 shoulder-mounted rifle, and the 9 mm semiautomatic Beretta handgun. The M16 automatic, or select-fire, rifle and the AR15 semiautomatic rifle have been the standard-issue weapons of the U.S. military and civilian police departments for decades. The rifle design was originally created by Eugene Stoner and developed by Fairchild Engine and Airplane Company in the 1950's. Modified versions of the M16 designated as the M16A1 and the M16A2 are currently in use by armed forces in the U.S. and throughout the world. A civilian semiautomatic version of the M16, designated as the AR15 is sold to civilians by Olympic Arms, Inc. of Olympia, Wash. When used herein, the phrase "M16" is intended to include all versions of the M16 and AR15 previously and currently being produced.

One of the original patents issued on the M16 rifle was issued to Eugene Stoner on Sep. 6, 1960, as U.S. Pat. No. 2,951,424, and disclosed the M16 bolt and bolt carrier system as well as the gas system used therewith. The patent discloses a rifle utilizing a gas tube that extends from a gas port in the barrel, through the front sight base, back into the receiver, and into a gas tube pocket or "gas key" attached to the bolt carrier. Stoner also received U.S. Pat. No. 3,198,076 on Aug. 3, 1965 which discloses a gas operated, magazine-fed rifle that can be readily converted to a belt-fed machine gun by inverting the barrel assembly.

More recently, patents have been issued on modified M16 rifles that are chambered for the relatively low-pressure, short wide pistol cartridges such as the 9 mm, the 10 mm, and the .40 S&W calibers. These cartridges generate approximately half the internal gas pressures that normal rifle cartridges such as the 5.56 mm Nato cartridge do. For example, the 9 mm generates pressures in the range of 20,000 to 30,000 CUP whereas modern military rifle cartridges generate pressures in the range of 45,000 to 55,000 CUP (copper units of pressure). Two such patents disclosing modified M16 rifles for firing pistol cartridges are U.S. Pat. No. 5,499,569 and U.S. Pat. No. 5,520,019, dated Mar. 19, 1996, and May 28, 1996, respectively, both issued to Brian D. Schuetz and assigned to the assignee of the present invention. Two other patents disclosing modified M16 rifles are U.S. Pat. No. 5,448,940 and U.S. Pat. No. 5,351,598, issued on Sep. 12, 1995, and Oct. 4, 1994, respectively, to Robert C. E. Schuetz et al. The aforementioned six patents issued to Stoner and Schuetz, et al, are all incorporated herein by reference in their entirety.

In the training of military troops and civilian police forces, the trainers are limited to the types of firearms that can be used in such training because of the inherent dangers in using live ammunition during training exercises. The alternatives to using live ammunition include using blanks in standard military weapons such as the M16 or using non-military pseudo-weapons such as CO2 operated rifles that shoot frangible projectiles made up of plastic capsules filled with a colored marking fluid such as watercolor paint (often referred to as "paintball guns"). The advantages of shooting blanks in actual military rifles is that the trainees actually get the feel of the weapon they will be carrying; however the disadvantage is that no one can tell how accurate the trainee is under training conditions because of the lack of projectiles with the blank cartridges. The alternative offers the opposite advantages and disadvantages, i.e. the CO2 guns do not resemble the military type of weapons in design, weight, handling and all other aspects, even though they do provide a projectile that allows some tracking of accuracy; although only at very limited distances because of the lack of velocity and distance with the CO2-driven frangible projectiles.

What has long been needed has been a system of firing simulated ammunition from weapons such as the M16 rifle and the 9 mm Beretta handgun which are standard-issue weapons in the U.S. military.

SUMMARY OF THE INVENTION

The present invention overcomes the deficiencies of the conventional weapons systems by providing a system and method of use wherein simulated ammunition can be fired in M16 types of rifles and 9 mm handguns and still maintain the appearance and effectiveness of these types of guns. The modified M16 rifle of the invention is adapted for use with simulated ammunition which is currently available commercially, while also having a safety system to prevent the effective firing of live ammunition in the modified gun. The safety system comprises a blowout passage in the gun's chamber which would allow the sidewall of a standard, live-ammo cartridge, which is inadvertently loaded in the gun and fired, to blow out and bleed off the pressure, thereby preventing the normal copper-jacketed lead bullet from traveling down the bore of the rifle and presenting a danger during any training exercise.

The invention is also particularly advantageous in all types of handguns, other types of rifles such as lever action, bolt action, single shot, and multiple-barrel rifles, as well as in all types of shotguns.

DESCRIPTION OF THE PREFERRED EMBODIMENTS

Figure 1:
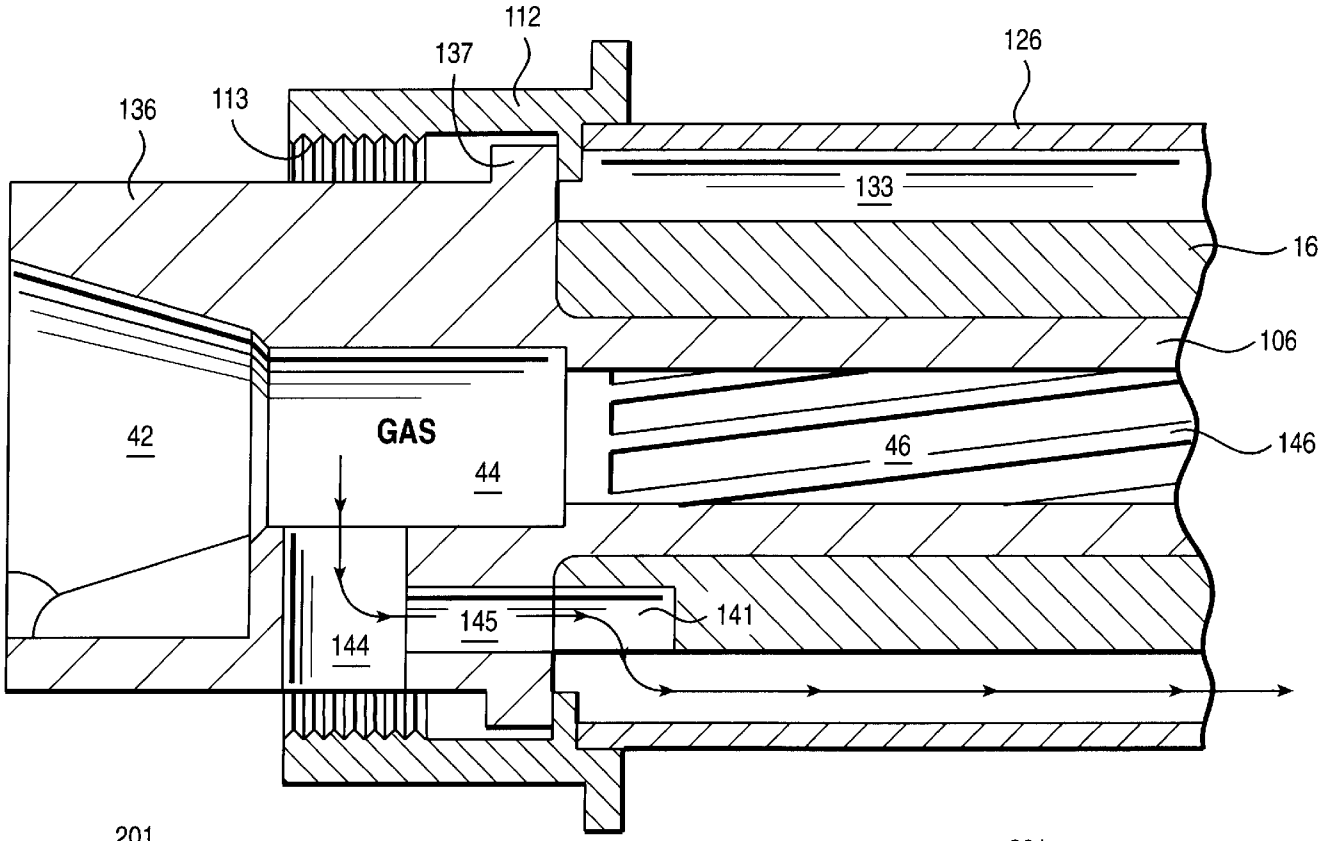
FIG. 1 is a partial cross-sectional drawing of the chamber area of the modified M16 rifle of the present invention illustrating the pressure relief system of the invention.

The present invention will be described in reference to the modified M16 as disclosed in the aforementioned incorporated Schuetz patents, U.S. Pat. No. 5,499,569 and 5,520,019. It will also be described in reference to commercially available simulated ammunition such as that manufactured according to U.S. Pat. Nos. 5,492,063; 5,359,937; and 5,375,529; the specifications of which are hereby incorporated by reference. Reference numbers in this application refer to similar or identical features of the same-numbered features in the incorporated Schuetz patents. The aforementioned modified M16 rifle has been further modified in this invention by replacing the barrel, the chamber assembly, and the barrel nut with the modified parts illustrated in FIG. 1.

In the figure, a cartridge chamber 44 is machined or cast into a steel barrel extension 136 which is a generally cylindrical collar having the chamber substantially centrally located therein and a cylindrical rifled bore 46 extending forward therefrom. Rifled bore 46 is defined by cylindrical extension tube 106 formed on the forward end of barrel extension 136. A generally conical-shaped breech 42 is formed in the rearward end of extension 136 and feeds into chamber 44. Chamber 44 is of the same size and shape as a standard pistol cartridge such as the 9 mm Parabellum (9×19 mm) cartridge. Tube 106 is formed with a plurality of internal helical rifling grooves formed therein. The bore diameter of bore 46 is substantially less than the bore of a conventional weapon that would be chambered for the same cartridge as the chamber 44. For example, in one embodiment of the invention chamber 44 was machined to fit the 9 mm Parabellum cartridge which has a nominal diameter of 9 mm or about 0.360 inches. The bore diameter for a conventional 9 mm weapon is in the range of about 0.355 to about 0.360 inches. The bore diameter however for the present invention where the chamber is set for 9 mm is only about 0.300 inches to 0.310 inches, a reduction of almost 0.060 inches from the conventional bore size. Therefore it is obvious that a conventional projectile from a 9 mm live cartridge would not be able to pass down bore 46 due to the huge interference caused by the 0.060 inch bore difference. This is a safety factor arranged to prevent an accidental firing of a live round during a training exercise, and is more fully described hereinbelow with respect to the mode of operation of the invention.

A tightly-fitted barrel 16 slides over tube 106 and provides barrel structure and weight similar to a standard 9 mm M16 barrel. A conventional M16 barrel nut 112 slides over a radially extended shoulder 137 and attaches to the M16 receiver (not shown) via internal threaded section 113, thereby securing the barrel/chamber assembly to the M16 receiver. Barrel 16 may be attached to internal barrel tube 106 by conventional means such as screws, pins, welding, etc.

Breech 42 is shaped and sized to receive the conical bolt face of the modified M16 rifle of the aforementioned incorporated Schuetz patents as described therein. The difference between the present chamber structure and the aforementioned M16 chamber structure is the presence of the gas relief port 144 passing through the wall of barrel extension 136. Port 144 may be a cylindrical hole bored completely through the wall of the barrel extension. It also communicates with a forward extending gas exhaust channel 145 that goes from port 144 and exits out the forward face of the barrel extension. Barrel 16 has a similar gas channel 141 formed in the outward edge of the rearward end of the barrel and adapted to align with channel 145. Although gas port 144 is shown extending all the way through the wall of barrel extension 136, this is done only for ease of forming the port, and in fact the port only needs to extend radially outward far enough to communicate fully with channels 145 and 141. Channel 141 extends forward sufficiently to clear the end of sleeve 126 and to communicate effectively with the annular space 133 formed by the concentric arrangement of blast sleeve 126 around barrel 16. Relief port 144 is arranged to intersect the chamber wall so that it will also intersect the wall of any conventional brass ammunition cartridge which is inadvertently inserted into the weapon's chamber.

Figure 2:
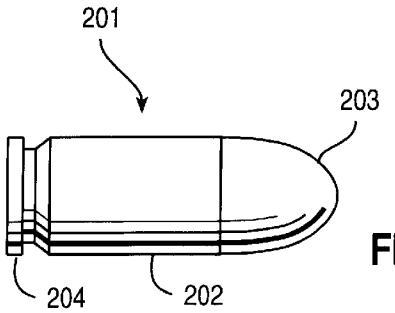
FIG. 2 is a drawing of a live-ammunition round typical of the commercially available handgun cartridge such as the 9 mm Parabellum; and, FIG. 3 is a drawing of a typical simulated training round in 9 mm for use in the present invention.

FIG. 2 is a side view of a conventional pistol cartridge live round 201 having a brass or other type of metal case 202, and a projectile 203 consisting of a metal-jacketed lead bullet. An extractor rim 204 is formed on the rear face of the case 202. Cartridges 201 are commercially available all over the world in calibers such as 9 mm, 10 mm, 380 acp, and .40 S&W. The case 202 holds a primer system in the base and gunpowder inside the case below the bullet. Internal pressures generated during ignition of such cartridges are in the range of 20,000 to about 35,000 CUP (copper units of pressure).

Figure 3:
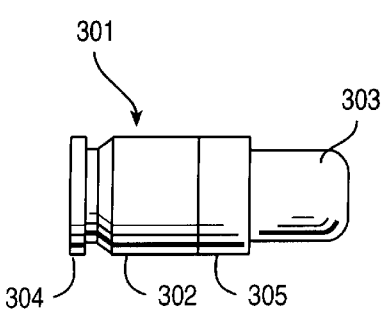

FIG. 3 is a side view of a simulated cartridge 301 used in training weapons for simulating the action of a conventional live round. They are commercially available in 9 mm caliber and are made according to the aforementioned incorporated patents. Primarily they consist of a metallic case 302, a rimmed base 304, a plastic or otherwise frangible projectile 303, and a plastic bushing or piston 305. The simulated cartridge is designed to fire a light frangible projectile at lower than conventional velocities while still providing sufficient force to operate the bolt system of the blowback M16 of the aforementioned Schuetz patents. The plastic piston 305 serves to provide a rearward directed force to case 302 to cycle the blowback bolt system of the modified M16 rifle. Projectiles 303 are light enough and frangible enough to prevent injury to any person struck by one during training exercises. If desired, the projectiles may be filled with a brightly-colored marking liquid such as watercolor paint or other type of non-permanent paint or dye. It should be noted that the diameter of the projectile in the simulated cartridge is substantially smaller than a like cartridge in a live round. For example in the 9 mm cartridge mentioned previously, the nominal diameter of a 9 mm lead projectile is in the range of 0.350 to 0.360 inches, whereas the nominal diameter of a 9 mm simulated round projectile is only about 0.300 to 0.310 inches. This is true even though the case diameter of the simulated round is approximately the same as the case diameter of a standard 9 mm cartridge so that conventional magazines can be used with the simulated rounds.

In typical operation, the simulated cartridge 301 is moved into chamber 44 by the action of the bolt assembly of the modified M16 just as though it were a conventional cartridge and as further described in the aforementioned Schuetz patents. Then the activation of the firing pin by movement of the trigger fires the simulated cartridge and drives the light frangible bullet down the grooved internal barrel 106. The rearward push of the case 302 against the bolt face cycles the gun and allows the fired case to be ejected and a fresh round to be inserted into the chamber. This process continues until all of the ammunition available to the firearm from the magazine is exhausted or until the operator of the weapon decides to quit firing.

The operation of the system when the operator inadvertently tries to fire a conventional high-power cartridge in the weapon serves to protect both the weapon, the operator, and anyone else in the area involved in the training exercise. When an actual live round (non-simulated) of the same caliber as the simulated cartridge, is inserted into the weapon by mistake or when an uneducated attempt is made to fire such a round in a modified M16, the rifle will allow the cartridge to be fired just as though it was also a simulated round. However, the action of the system immediately after the firing of the live round becomes very different from that of the conventional M16 rifle and of the simulated round.

With the present safety system, when the live round 201 is fired in the modified chamber 44, the pressure which builds up rapidly in the cartridge to the aforementioned CUP range, immediately begins to stress the cartridge wall at its location over port 144, stretching the metal of the case wall into the port until it ruptures and blows a hole in the case wall slightly smaller than the diameter of port 144. This allows the buildup in gas pressure inside the cartridge case 202 to entirely bleed off through the port and out channels 145 and 141, where it is dissipated by blowing forward into annular space 133. This space allows the gases to exit the rifle near the end of the handguard after it has been cooled and slowed by its great increase in volume.

By the time the gases exit annular space 133 they are no longer of any danger to the weapon operator nor to anyone in the area of the weapon. Because of the rapid blowout of the case wall, the bullet 203 never has the opportunity to exit the case 202 and is easily extracted as a single unit along with the case by the cycling of the bolt by the weapon's operator. This system will operate the same each time a live round is attempted to be fired in the weapon so that no matter how many live rounds the weapon's magazine contains, the operator will never be able to fire an actual bullet from this firearm. Also, the noise and gases exiting from the handguard area, and the lack of a projectile from the weapon, serve to give the operator and those around him a very clear indication that the weapon has been loaded with live ammunition instead of simulated ammunition.

In the event however, that a bullet in a live cartridge is lightly crimped in its case and the cartridge is loaded into the modified weapon of this invention and fired, and the bullet does manage to leave the case and move forward into the barrel, it will not have enough pressure behind it to move any further than the very beginning of rifled section 46 where, because of the previously described reduction in bore diameter 46, it will encounter enough resistance to prevent it from traveling out of the immediate chamber area. Then, if the rifle cycles and tries to load a new cartridge into the chamber, the cartridge will not go into the chamber because of the presence of the lead bullet in the end of chamber 44 abutting the rear end of rifled bore 46, and the operator will realize that a live round was attempted to be fired in the weapon. Thereafter it will be a simple matter of clearing the chamber of the fresh round, running a cleaning rod down the bore from the muzzle end and lightly tapping the fired bullet loose from where it is lightly lodged in the rearward end of rifled section 46.

Thus it can be seen that the present invention provides a modified M16 rifle system for firing simulated ammunition, which rifle system offers the features of having a fail-safe system for preventing the firing of live ammunition and thereby not endangering the lives of personnel involved in the training exercise.

In an alternate embodiment of the invention, as mentioned hereinabove with respect to the Beretta semi-automatic pistol in 9 mm, .40 caliber, or any other caliber, the present invention can be utilized to transform this actual live-round firing weapon into a non-live-round training pistol. In this case, a typical semi-automatic handgun 401, such as the Beretta model 92, is illustrated in full side view. The handgun 401 has a metal or polymer frame 402 upon which is mounted a modified barrel 403 partially located inside a standard slide member 404. The barrel 403 has a muzzle end 405 and an enlarged chamber end 406. The bore 407 of the barrel may optionally be smaller in internal diameter than the bore of a standard 9 mm or .40 caliber barrel to insure that bullets of either of these calibers will not pass therethrough. This is in order to prevent live rounds from being fired during training exercises, which would be a very dangerous situation. The barrel can consist of a modified barrel with smaller bore capable of passing only training rounds therethrough, or can be a standard barrel containing a cylindrical bore liner that reduces the bore diameter to a smaller dimension that matches the diameter of the training round. However, it should be noted that it is not absolutely necessary that the bore be smaller than that of a standard barrel, and in fact, a standard barrel may be utilized with the present invention as long as the relief port is sized substantially large enough to allow the cartridge case wall to be ruptured outward before the bullet can progress substantially into the barrel bore. This is due to the fact that most rifled barrels are set up to provide a very tight fit with the bullets designed for them, there being a need to extrude the bullet outer surface into the rifling of the barrel to seal off the bullet against gas leakage around the bullet in the barrel and to provide the spin to the bullet that stabilizes it, arising from the "twist" of the rifling in the barrel.

Whether or not the maker of the training weapons chooses to provide a smaller-than-standard bore diameter on a handgun or rifle to shoot training bullets or riot-control rubber bullets, it becomes critical to provide a safety measure in case the gun operator tries to fire a live round (non-training round) through the weapon. If not, then the bullet from the live round will either exit the normal-sized barrel at normal muzzle velocities and endanger everyone downrange in the training facility, or else the bullet will lodge in the smaller-diameter barrel and cause the weapon to fail catastrophically. This is where the present invention is advantageous in providing a safety release for the high pressures created in firing a live round.

By applying the present invention to the semi-automatic pistol, a pressure relief opening or port 408 is formed through the wall of the pistol chamber 406 so that the pressure created inside the live round when it is fired will have an escape mechanism rather than trying to drive the normal bullet down the barrel. The port must be located though where it will not endanger the operator or any bystanders. This necessitates that the port or opening not be formed in the portion of the barrel that is exposed to the side of the shooter. Thus, the port is preferably located in the chamber portion located under the slide or, if the barrel is not covered by the slide on the top or side, then the opening should preferably be on the bottom of the barrel chamber, or on the top of the chamber where the discharge of gas and brass cartridge particles will be upward and away from the shooter and any bystanders.

In the present invention, the opening 408 is illustrated along the bottom of the chamber portion of the barrel facing the internal portion of the pistol frame 402. In this manner, when a live round is erroneously placed in the chamber and fired, the bullet will leave the cartridge case and impinge the beginning of bore 407. Rising pressure in the brass cartridge case will rupture the side wall of the case at aperture 408, blowing the brass wall of the case through the aperture and bleeding the rising pressure from the burning gunpowder downward into the frame area of the pistol. As previously mentioned, alternate locations of the relief aperture would be any location on the chamber where the aperture would be shielded by the slide mechanism 404, thereby protecting the gun operator from expelled brass fragments and hot gases from the gunpowder. In a case where the barrel is almost entirely exposed on the top and both sides, as in the Beretta model 92, the aperture would preferably be located in the bottom area of the chamber to direct the exhausted gases and brass fragments downward into the frame open area or into the magazine well. Most guns have some open areas inside their frames where the spent gases could be dissipated.

Figure 4:
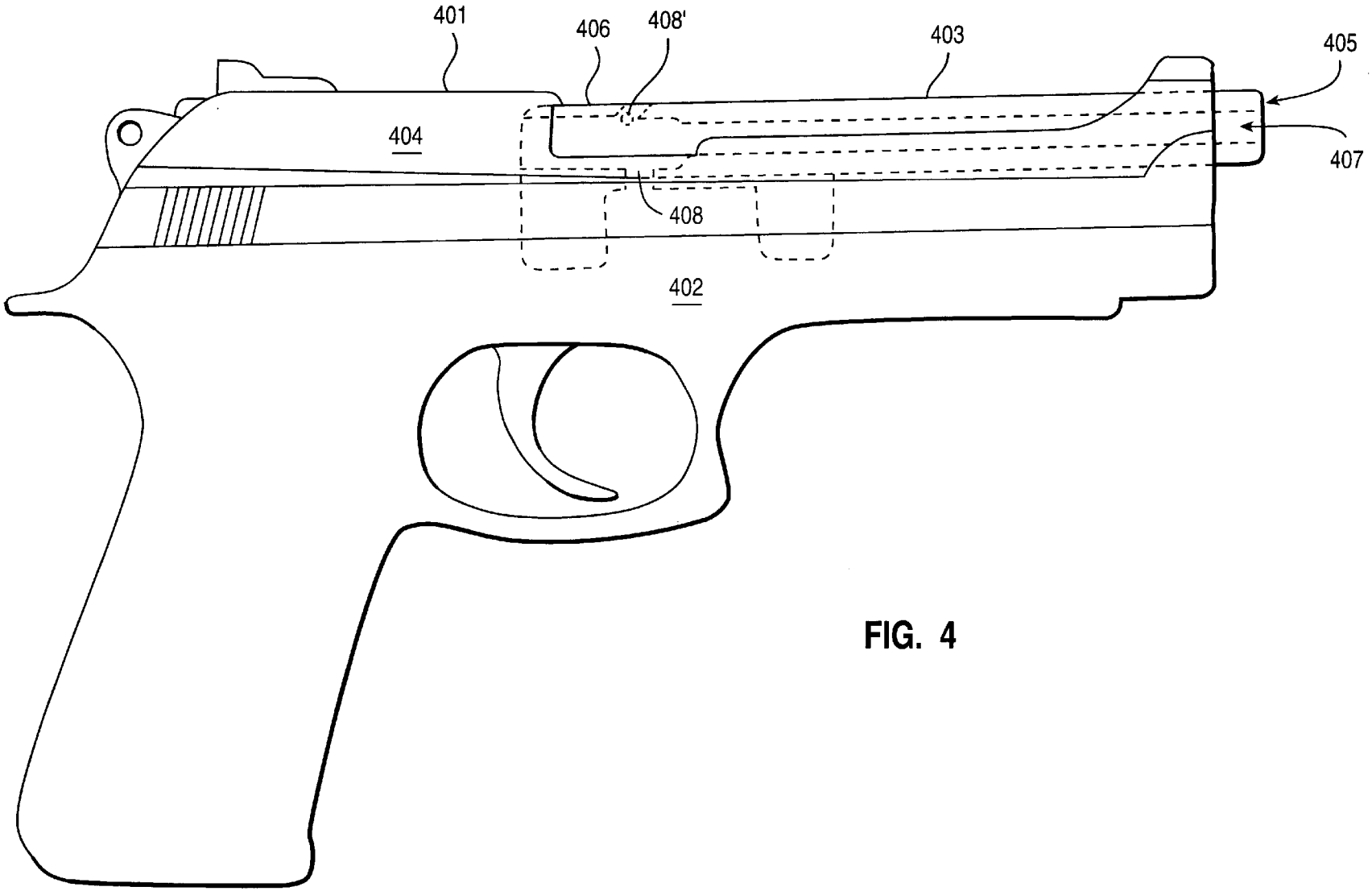
FIG. 4 is a schematic side view of a typical semi-automatic pistol having an exposed barrel not covered by the slide, such as the Beretta model 92 as used by the United States Military Forces, showing the present invention installed therein.

Alternatively, and not as advantageous, would be to place the pressure relief aperture 408 on top of the chamber to allow spent gases and cartridge wall remnants to exit upward from the weapon when a live round is inadvertently fired in the gun. This is not as preferable as venting these elements into a closed area under the slide or into the frame/magazine well area, but it is still not as dangerous as venting the gases sideways towards nearby personnel. Also venting the gases upward would be very similar in effect to the "compensated" barrel type of pistol which has "compensator" ports machined into the top surface of the muzzle end of the barrel. Alternate locations are illustrated in phantom lines in FIG. 4 and designated by reference numeral 408'. When locating the pressure relief port in the top of the chamber, it is possible to angle the port toward the muzzle end of the barrel in order to further direct the discharge of gases and particles away from the shooter of the weapon. Any angle from one or two degrees, up to about 80 degrees from straight vertical could be used to slant the port and reduce exposure to the shooter.

Whereas the ports 408 are illustrated as circular in cross-sectional configuration for ease of machining purposes, it is possible to utilize other geometric shapes for the apertures or ports, as long as the ports are large enough in length and width to provide rupture of a standard brass cartridge and expulsion of the ruptured portion of the cartridge case wall through the port. Such shapes could include elliptical, or elongated shaped openings, as long as they penetrate through the chamber wall in the area of the cartridge wall and provide an escape route for gases and brass particles, which route does not endanger the operator of the gun or any possible bystanders.

In addition to the embodiment described above with respect to the Beretta model 92, the present invention is also very advantageous when used in handguns having an external slide member covering a substantial portion of the chamber portion of the barrel, unlike the Beretta which has a substantially exposed barrel. Examples of such handguns include the Glock models 17 and 19, as well as other Glock models, Smith & Wesson models 1006, 3913, Sigma, and other models, the SigArms models 226, 228, 239 and other Sig models, the Ruger model P89 and other Ruger P-designated models, and the Colt model 1911 .45 ACP and related Colt models in .45 and .380 caliber. Each of these handguns utilizes an external slide member which almost totally encloses the barrel and therefore provides a large number of desirable locations for the pressure relief port 408 passing through the chamber wall. The structure of each of these handguns is well-known to those skilled in the handgun arts, which includes most handgun shooters, weapons designers, and weapons manufacturers.

Figure 5:
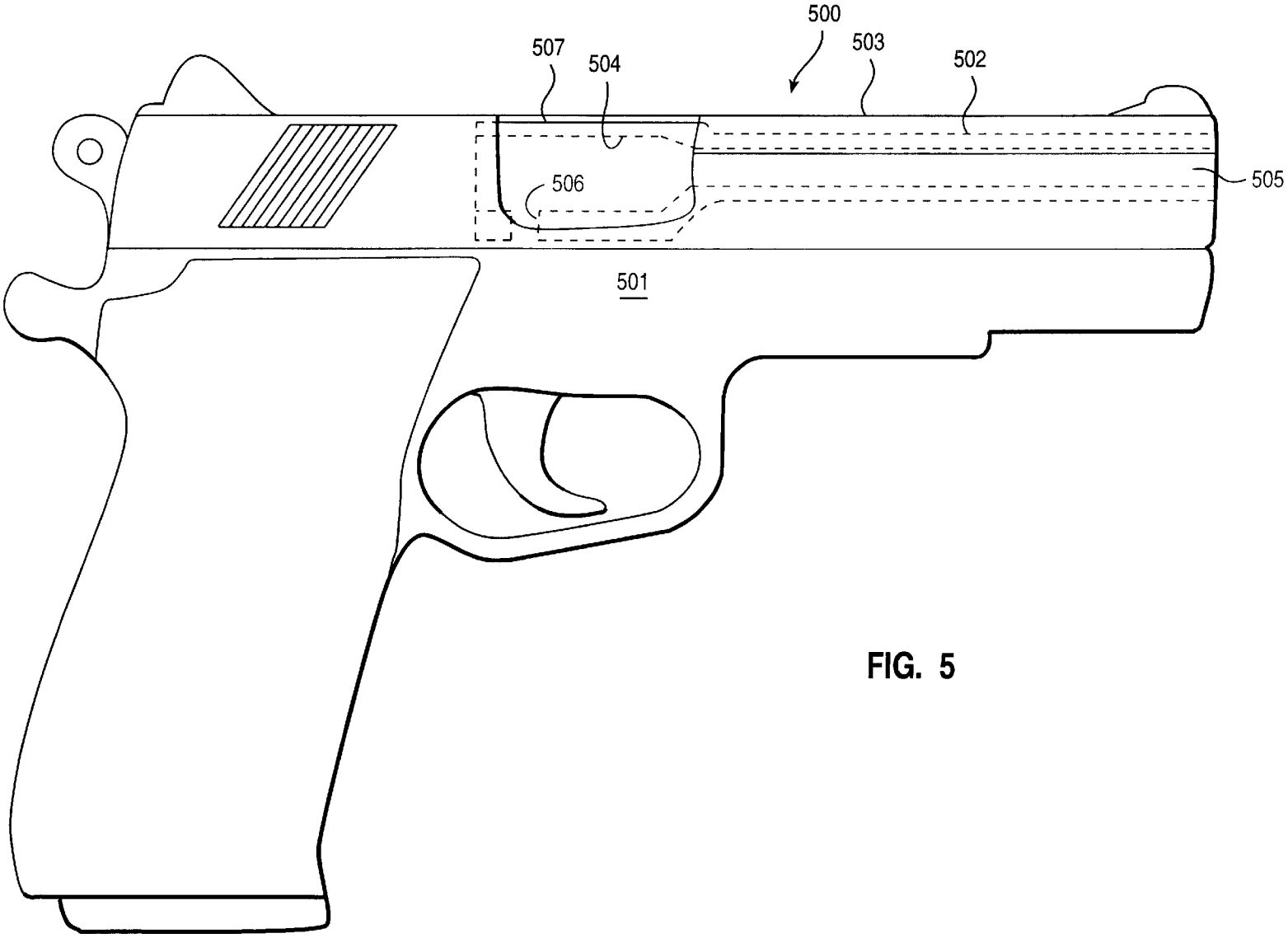
FIG. 5 is a schematic side view of a typical semi-automatic pistol having a barrel that is substantially covered by the slide, such as the Colt model 1911 .45 ACP pistol and the Smith & Wesson model 1006.

FIG. 5 illustrates a full side view of a typical slide-enclosed barrel type of handgun 500 as mentioned in the paragraph above. In this type of handgun, which is typical of the Glocks, Smith & Wessons, Rugers, Colts, and Sigs mentioned above, the handgun comprises a frame member 501 made of metal or polymer, upon which is mounted a barrel 502 and a slide assembly 503 enclosing the barrel assembly. The barrel 502 has a cartridge-firing chamber portion 504 machined to receive a standard caliber cartridge. The barrel also has a rifled or smooth bore 505 which optionally may be of smaller diameter than the bullet of the standard cartridge for which the chamber is machined. The bore 505 may be sufficiently smaller than the standard bullet diameter that a standard caliber bullet can not pass through the bore when the cartridge is fired.

In the chamber portion of barrel 502 a pressure relief port 506 is formed through the wall of the chamber adjacent to where the brass cartridge will be located when fully chambered in the handgun. This port passes from the interior wall of the chamber 504 to and through the exterior wall of the chamber portion of the barrel assembly. Preferably port 506 is located in a portion of the chamber that is normally located inside the slide assembly 503, such as along the top or the left-hand side of the chamber opposite the ejection port area 507 of the handgun. This allows expelled gases and brass particles which are blown through the relief port to be shielded from the handgun operator and bystanders. Alternatively, the port could be located along the bottom portion of the chamber to allow diversion of expelled gases and cartridge wall pieces to pass downward into the internal area of the frame or into the magazine well, depending upon the design of the particular weapon and/or the location of the port 507 along the length of the cartridge chamber.

It should be noted that when used in handguns, the present invention does not require a pressure relief channel as described above with respect to the M-16 rifle. Although such a relief channel leading from the relief port (408, 506) could be provided in the handguns above, because of the relatively smaller sizes of handguns when compared to rifles, the provision of a relief channel is not as easily accomplished and therefore may not be practical in most handguns. This is particularly true when the handgun has a frame assembly with an internal cavity near the chamber area that can be used to receive expelled gases and brass particles from the ruptured cartridge. And even though such gases and brass particles may cause difficulty in further operation of the handgun due to jamming of the pistol internal parts, this is preferable to having a live bullet being expelled from the bore of the barrel toward an innocent person in a training situation.

Figure 6:
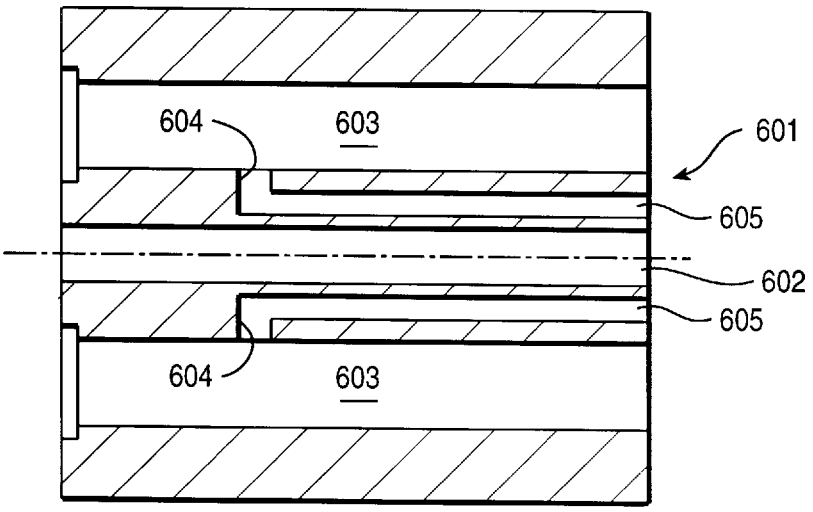
FIG. 6 is a schematic cross-sectional side view of a typical cylinder from a revolver such as a single-action Colt, model SAA, or a double-action Smith and Wesson, such as the model 686, illustrating the present invention installed therein.
Figure 7:
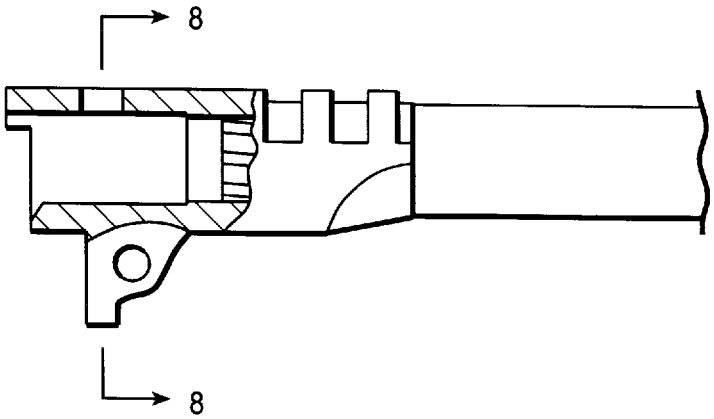
FIG. 7 is a partial cross-sectional side view of a typical barrel/chamber assembly from a handgun such as the Colt 1911 Government model, illustrating the invention installed therein.
Figure 8:
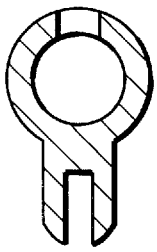
FIG. 8 is a cross-sectional axial view of the barrel/chamber assembly of FIG. 7 taken at line A—A therethrough.

FIG. 6 illustrates a cross-sectional view of a typical revolver cylinder 601 from a single action revolver such as the Ruger Blackhawk or Colt Single Action Army. The cylinder is also representative of one used in the typical double action revolver such as the Smith & Wesson model 686 or the Ruger Redhawk. Other double action revolvers include the Colt Python and King Cobra and the Ruger Safety Six. The cylinder 601 is formed of a metal such as steel or aluminum and contains a central cylindrical bore 602 for mounting the cylinder on the cylinder spindle in the revolver frame. The cylinder has a number of cartridge chambers 603, usually five to ten in number, to receive the cartridge being fired. The cylinder is oriented in the figure so that the rear of the cylinder is to the left and the front of the cylinder is toward the right. In the present invention the cylinder cartridge chambers 603 are conventional to receive conventional-sized cartridges. However, to prevent the successful firing of live ammunition in the training revolver, which has a smaller-than-standard rifled bore in the barrel, a pressure relief port 604 is formed in the side of each cartridge chamber 603. The relief port does not pass through the entire wall of the cylinder but intersects a longitudinal pressure bleed-off channel 605 passing forward to the front end of the cylinder. Thus when a standard live round cartridge is inadvertently inserted in the training revolver and fired, the bullet will jam in the rearward end of the barrel and the pressure in the cartridge case will rupture the side of the cartridge and be expelled through port 604 and into channel 605, exiting harmlessly forward from the cylinder. The remainder of the revolver is not illustrated in the drawing because it is of conventional design except for the bore which is merely made in a lesser diameter than standard bore for that particular revolver. This is similar in construction to the M-16 described above, and can consist of an integral barrel with a smooth or rifled bore manufactured sufficiently smaller in internal diameter than standard to prevent passage of the standard caliber bullets therethrough, or alternatively, a liner can be fixedly attached in the bore of a standard handgun barrel to prevent such bullet passage.

Also, whereas the relief port in each of the above-noted semi-automatic pistols is shown passing directly through the chamber wall to the outer surface of the chamber, it is also possible to have the relief port exit to a relief channel or bore passage that is directed to the desired outer portion of the chamber that is shielded by either the slide or the frame of the weapon. While this modification is not illustrated specifically herein with respect to handguns, it is clear that one skilled in the art, given the description hereinabove with respect to M-16 type rifles, could easily modify any handgun to incorporate such a channel system without undue experimentation.

In typical operation, the handgun, rifle, or shotgun intended for use as a training weapon with simulated plastic or rubber bulletted cartridges, has the above-described relief port formed through the wall of the cartridge chamber. The port may be circular or elongated and is of a size sufficient to allow the cartridge wall to rupture through said port if a standard-bullet live round is introduced into the chamber and fired.

As mentioned previously, the sizing of the port depends upon the bore of the barrel being used on the training weapon. If the standard-bore barrel is retained on the weapon, the port must necessarily be larger than if a restricted-bore barrel is used, such as that described above with respect to the M-16 rifle. When a restricted bore barrel is used on a handgun such as the Colt 1911 Government model in .45 ACP caliber, a circular-shaped port having a diameter of about 0.20 up to about 0.30 inches in diameter is sufficient to prevent passage of a standard bullet down the restricted bore passage. If a standard bore barrel is used however, the port should be more on the order of 0.35 to 0.40 inches in diameter for the .45 ACP caliber gun.

When a live round is fired in the training weapon, the bullet tries to enter the tight bore passage and pressure builds up inside the cartridge case in the chamber. Normally this pressure would be contained in the brass cartridge by the support supplied by the surrounding steel chamber wall in the barrel. However, a portion of this support has been removed in the form of the relief port of this invention. Since the resistance to bullet travel exceeds the strength of the unsupported cartridge case over the relief port, cartridge brass being relatively very soft, the build-up of pressure in the cartridge takes the path of least resistance, i.e., by rupturing the cartridge case and blowing out through the relief port. The pressure from the expanding gases formed by the burning gunpowder in the cartridge are all allowed to bleed off harmlessly through the relief port into a non-dangerous area inside or outside of the weapon. The bullet that is slightly lodged in the very beginning of the rifled bore will prevent the loading and firing of a second standard live round and notify the shooter that something is amiss and needs attention.

Although the invention is described with respect to the military style rifles, it is clear that the invention could easily be applied as well to semiautomatic sporting rifles such as the Ruger Mini 14, the Springfield M1A1/M14 style rifles, the Browning BAR, and the Remington model 7400 semi-auto rifles; as well as other types of rifles, such as single-shot, lever, and bolt action rifles, and shotguns. And further, it is evident that the invention could be utilized in more handguns than those specifically disclosed hereinabove, for example, in guns such as the Walther PPK and Luger Parabellum handguns. Even though a specific preferred embodiment of the present invention has been described in the detailed description above, the description is not intended to limit the invention to the particular forms or embodiments disclosed therein since they are to be recognized as illustrative rather than restrictive and it would be obvious to those skilled in the art that the invention is not so limited. Thus the invention is declared to cover all changes and modifications of the specific example of the invention herein disclosed for the purposes of illustration which do not constitute departures from the spirit and scope of the invention.

The embodiments of the invention in which an exclusive property or privilege is claimed are defined as follows:

1. In a firearm for firing simulated ammunition, the improvement comprising a barrel having at least one cartridge chamber associated therewith at one end thereof, and a pressure safety system adapted for preventing the successful completion of a firing cycle of live ammunition, said safety system comprising a pressure relief port formed in the wall of said chamber and arranged to align with the wall of a live cartridge located in the chamber of said firearm, said port being of sufficient size to allow a portion of the wall of a cartridge fired in said chamber to be blown out and expelled through said port, and said port being located on said chamber such that gases expelled therethrough are not directed at personnel operating the firearm nor at persons standing to the side of such operating personnel.

2. The firearm of claim 1 wherein said firearm is a handgun.

3. The firearm of claim 2 wherein said handgun is a semiautomatic pistol having a frame and a slide member, with said barrel being at least partially held in said slide member, in a slidable relationship therewith.

4. The firearm of claim 2 wherein said handgun is a revolver having a rotatable cylinder with at least one cartridge chamber formed therein, with said chamber having said relief port formed in the wall thereof.

5. The firearm of claim 4 wherein said revolver further comprises a pressure relief channel formed in said cylinder communicating with said port and adapted to direct expelled gases from said port in a direction away from the handgun shooter and nearby personnel.

6. The firearm of claim 3 wherein said relief port passes completely through the wall of said chamber and is located in the bottom portion of said chamber, directed downwardly toward said frame.

7. The firearm of claim 3 wherein at least a portion of said chamber is shielded from the outside by said slide, and said port exits said chamber wall in the shielded portion of said chamber.

8. The firearm of claim 1 further comprising a reduced-diameter bore in said barrel, sufficiently smaller than the standard bore of the nominal caliber of said firearm to prevent a standard bullet from being fired therethrough.

9. The firearm of claim 3 wherein said relief port passes completely through the wall of said chamber and is located in the upper portion of said chamber, directed upwardly therefrom.

10. The firearm of claim 4 wherein said relief port is angled forward toward the muzzle of said barrel and an angle from vertical of about 2 up to about 80 degrees.

11. A handgun for use as a training weapon for firing simulated ammunition having non-fatal bullets, said handgun having a frame upon which is mounted a barrel and a slide mechanism, said barrel having a cartridge chamber therein adapted to receive a simulated training cartridge, and said barrel further having a bore therethrough passing from said cartridge chamber to the muzzle end thereof, and said chamber having a relief port formed in the wall thereof adapted to communicate with the side of a cartridge in said chamber and further being of a sufficient size to cause the rupture a standard cartridge sidewall of a standard live round being fired in said weapon, said relief port arranged on said chamber to direct gases and cartridge particles in a direction away from the shooter of said weapon and any personnel who could be standing near said weapon when it is fired.

12. The handgun of claim 11 wherein said port is located in a position on said chamber where it is located under a portion of said slide when a cartridge is fired in said chamber.

13. The handgun of claim 12 wherein said port is located in the bottom portion of said chamber directed toward said handgun frame.

14. The handgun of claim 12 wherein said port is located on the upper portion of said chamber, directed upward.

15. The handgun of claim 14 wherein said port passes through the upper portion of said chamber at an angle toward the muzzle of said barrel of from about 2 degrees from vertical, up to about 80 degrees from vertical.

16. In a revolver handgun having a cylinder rotatably mounted in a revolver frame, said cylinder having at least one cartridge chamber formed therein adapted to align with a bore in a barrel mounted in said frame, the improvement comprising: said handgun adapted to be used as a training weapon for firing simulated, non-lethal rounds therethrough, and having a pressure relief opening formed in said chamber and adapted to allow the wall of a standard cartridge to be ruptured and blown out therethrough when a non-training round is fired in said revolver, said opening communicating with a passage arranged to direct gases and particles away from a shooter of said weapon and away from any possible bystanders.

* * * * *